US007246944B2

(12) United States Patent
Bois

(10) Patent No.: US 7,246,944 B2
(45) **Date of Patent: *Jul. 24, 2007**

(54) PACKAGING BAGS HAVING SLIDER-CONTROLLED CLOSURE STRIPS

(75) Inventor: Henri Georges Bois, Neuilly-sur-Seine (FR)

(73) Assignee: S2F Flexico, Henoville (FR)

( * ) Notice: Subject to any disclaimer, the term of this patent is extended or adjusted under 35 U.S.C. 154(b) by 285 days.

This patent is subject to a terminal disclaimer.

(21) Appl. No.: 10/613,147

(22) Filed: Jul. 3, 2003

(65) Prior Publication Data

US 2004/0060828 A1 Apr. 1, 2004

(30) Foreign Application Priority Data

Jul. 5, 2002 (FR) ..... 02 08442

(51) Int. Cl.
*B65D 33/34* (2006.01)
*B65D 33/16* (2006.01)
*B65D 33/00* (2006.01)

(52) U.S. Cl. ..... 383/5; 383/61.2; 383/64; 383/203

(58) Field of Classification Search ..... 383/5, 383/61.2, 202–203, 64
See application file for complete search history.

(56) References Cited

U.S. PATENT DOCUMENTS

| | | | | |
|---|---|---|---|---|
| 4,927,271 | A | 5/1990 | Branson | |
| 6,247,843 | B1 * | 6/2001 | Buchman | 383/5 |
| 6,264,366 | B1 * | 7/2001 | Custer | 383/5 |
| 6,286,999 | B1 * | 9/2001 | Cappel et al. | 383/5 |
| 6,287,000 | B1 * | 9/2001 | Buchman | 383/5 |
| 6,637,937 | B2 * | 10/2003 | Bois | 383/5 |
| 6,786,640 | B2 * | 9/2004 | Schneider et al. | 383/5 |

FOREIGN PATENT DOCUMENTS

| | | |
|---|---|---|
| EP | 0941937 | 2/1999 |
| EP | 1053947 | 11/2000 |
| FR | 2817843 | 6/2002 |

* cited by examiner

*Primary Examiner*—Jes F. Pascua
(74) *Attorney, Agent, or Firm*—Blakely Sokoloff Taylor & Zafman

(57) ABSTRACT

The present invention provides a bag having closure strips and a slider, and including a marker strip for preventing manipulation of the slider prior to the marker strip being ruptured, wherein said marker strip is formed integrally with a wall of the bag and includes a single-use adhesive zone designed to fix it in its in-use position on the opposite wall of the bag.

24 Claims, 3 Drawing Sheets

FIG.1
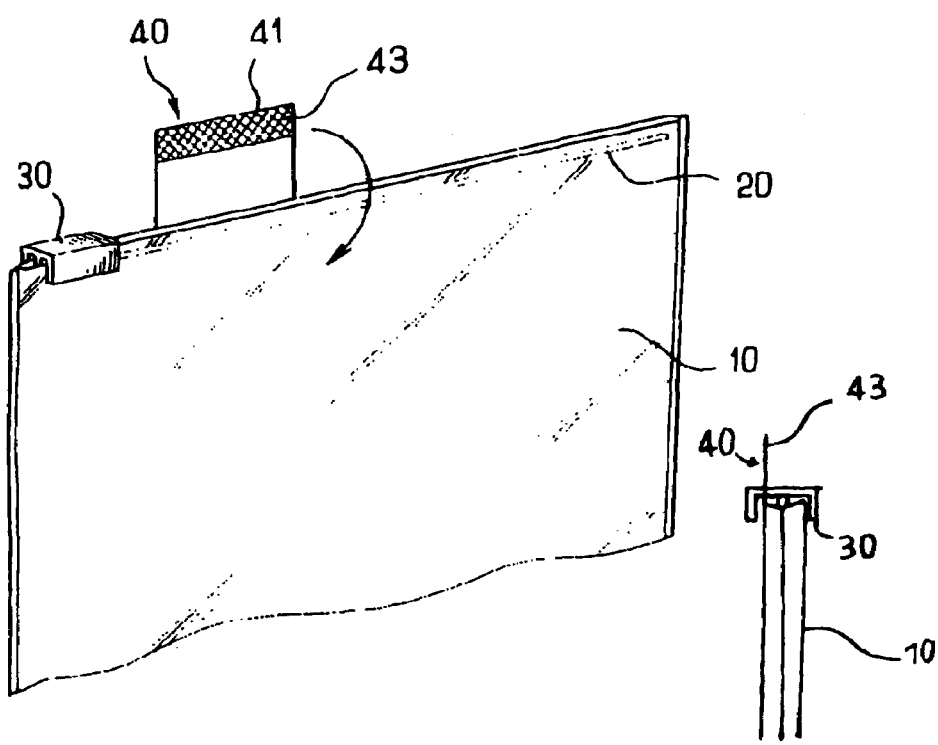
FIG.1a
FIG.2
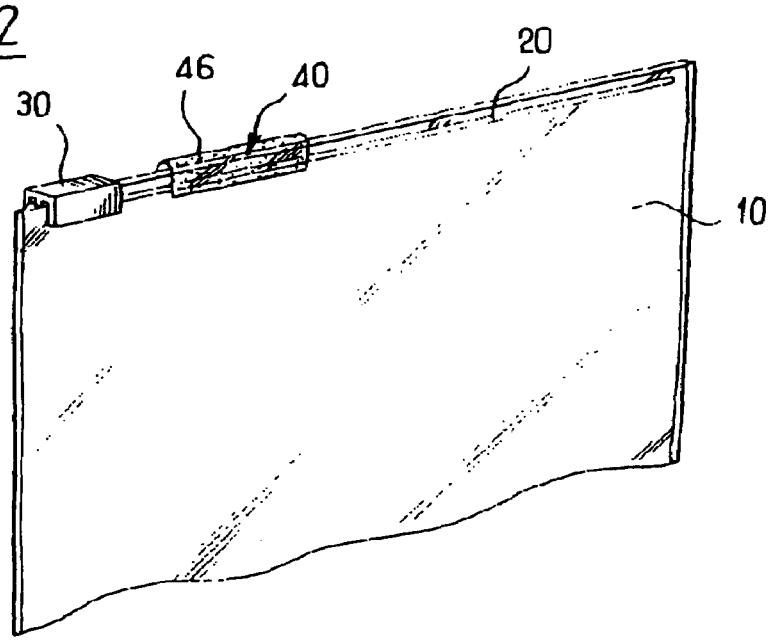

PACKAGING BAGS HAVING SLIDER-CONTROLLED CLOSURE STRIPS

The present invention relates to the field of packaging bags having closure strips for multiple opening and closing operations.

BACKGROUND OF THE INVENTION

Nowadays, most such bags are fitted with a slider designed to facilitate opening and closing the bags, respectively by separating and engaging closure strips.

In conventional manner, such sliders essentially define two channels receiving respective ones of the two closure strips, the channels being separated by a middle partition that is positioned between the two strips, or being associated with equivalent means adapted to act on the strips. The two channels converge towards each other at one end of the slider and diverge from each other towards the opposite end thereof.

Thus, depending on the direction in which the slider is moved, it tends either to move the strips towards each other and bring them into engagement so as to close the bag, or else to move them apart so as to open the bag.

Furthermore, at present, there exists a strong demand for a system that can be used to show whether or not such a bag has been opened for the first time.

Such first-opening markers that are available on the market are generally in the form of a web placed inside the closure strips and interconnecting the two walls of the bag, the web being designed to be ruptured on first opening, e.g. as described in document FR-A-2 546 481.

Proposals have also been made for packaging bags with closure strips, a slider associated therewith, and a marker strip placed on the path of the slider and designed to be ruptured by the slider on first opening.

In document FR-A-2 817 843, the Applicant has proposed a variant of such bags in which the marker strip is of two colors, presenting different colors respectively on its inside and outside faces.

OBJECTS AND SUMMARY OF THE INVENTION

An object of the present invention is to improve existing devices.

In the context of the present invention, this object is achieved by a packaging bag having closure strips, a slider associated therewith, and at least one marker strip adapted to prevent the slider being manipulated prior to the marker strip being ruptured, wherein said marker strip is formed integrally with a wall of the bag and includes a single-use adhesive zone designed to fix it in its in-use position on the opposite wall of the bag.

The term "single-use adhesive zone" is used to mean a zone provided with adhesive that presents adhesive properties such that once it has been put into place, it cannot be removed or unstuck without visibly destroying at least one of the bag support wall and the marker strip itself.

BRIEF DESCRIPTIONS OF THE DRAWINGS

Other characteristics, objects, and advantages of the present invention appear on reading the following detailed description with reference to the accompanying drawings given as non-limiting examples, and in which:

FIG. 1 is a diagrammatic fragmentary view in perspective of a bag in accordance with the present invention, prior to the marker strip being put into place;

FIG. 1*a* is a diagrammatic fragmentary profile view of a bag of FIG. 1.

FIG. 2 is a fragmentary diagrammatic view in perspective of the same bag in accordance with the present invention after the marker strip has been put into place;

MORE DETAILED DESCRIPTION

Figure 3:
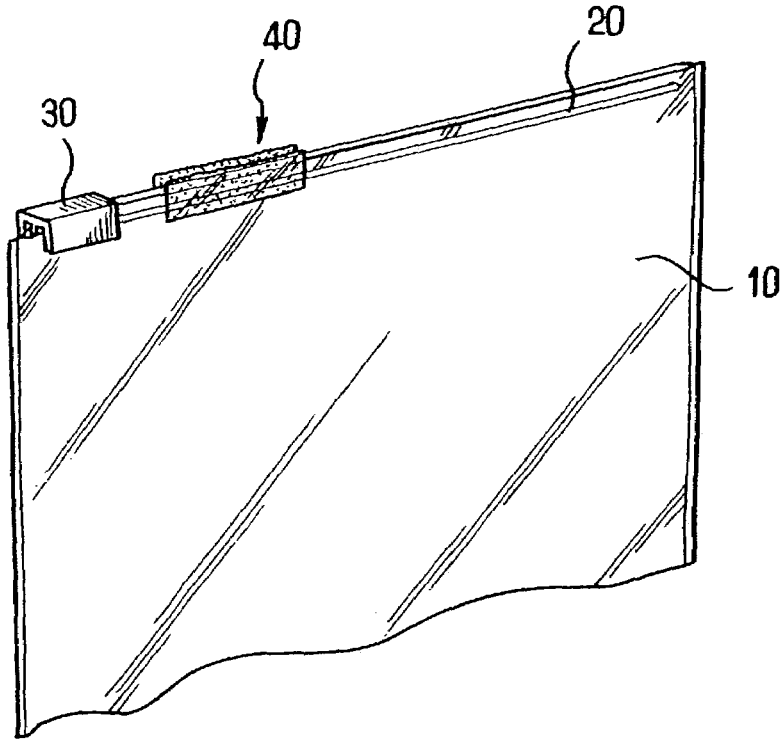
FIG. 3 is a similar diagrammatic view after the marker strip of the present invention has been ruptured.

In their general structure, the bags, closure strips, and sliders used in the context of the present invention may be constituted by any variant known to the person skilled in the art, in particular as to the material from they are made and the shape which they present.

Under such conditions, these elements are not described in detail below. Furthermore, they should not be considered as being restricted to the embodiments shown diagrammatically in the accompanying figures.

In the figures, the bags are given overall reference 10, the closure strips overall reference 20, and the slider overall reference 30.

As mentioned above, in the context of the present invention, a marker strip 40 is provided that is made integrally with one wall of the bag in the vicinity of the mouth of the bag, said marker strip being adapted initially, and prior to being ruptured, to prevent any manipulation of the slider 30.

In a first embodiment, as shown in FIGS. 1 to 4, the marker strip 40 is placed on the path of the slider 30 so as to ensure that said strip 40 is ruptured by the slider on first opening of the bag.

Figure 6:
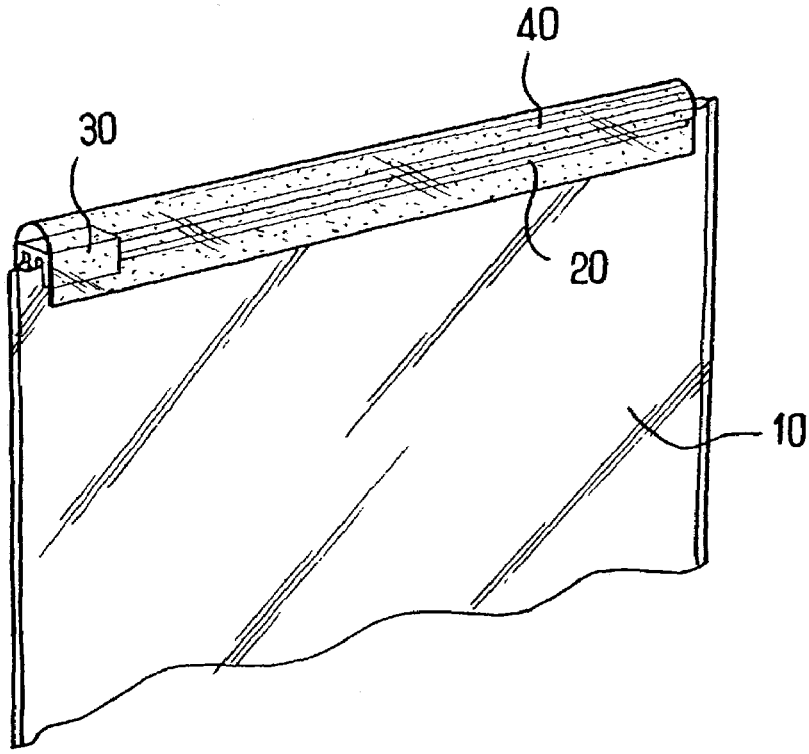
FIG. 6 is a diagram showing another variant embodiment of the present invention.

In a second embodiment, as shown in FIG. 6, the marker strip 40 is adapted initially to cover the slider so that the slider cannot be manipulated without rupturing the strip 40.

The marker strip 40 formed integrally with one of the walls of the bag is made out of the same material as that wall. It is therefore made out of plastics material.

In the particular embodiment shown in FIGS. 1 to 3, the marker strip 40 is formed by a strip of plastics material formed integrally with a longitudinal edge of a sheet constituting the bag, parallel with the mouth of the bag.

On its opposite free edge 41, the marker strip 40 is provided with a single-use adhesive zone 43 designed for fixing the marker strip to the bag on the path of the slider 30, as shown in FIG. 2.

For this purpose, the marker strip 40 is folded over as a U-shape with its concave side facing towards the body of the bag, and the adhesive zone 43 is fixed to the bag as shown in FIG. 2.

Still more precisely, the strip 40 is positioned adjacent to the slider 30 when it is in its bag-closing position. Thus, as soon as the slider 30 begins to be moved for the first time, the slider 30 engages the marker strip 40 and ruptures it.

FIG. 3 shows a marker strip 40 that has been ruptured by moving the slider 30.

Where appropriate, it is thus possible to provide a plurality of discontinuous or distinct marker strips 40 that are distributed along the mouth of the bag so as to make the fact of first opening more visible.

Figure 4:
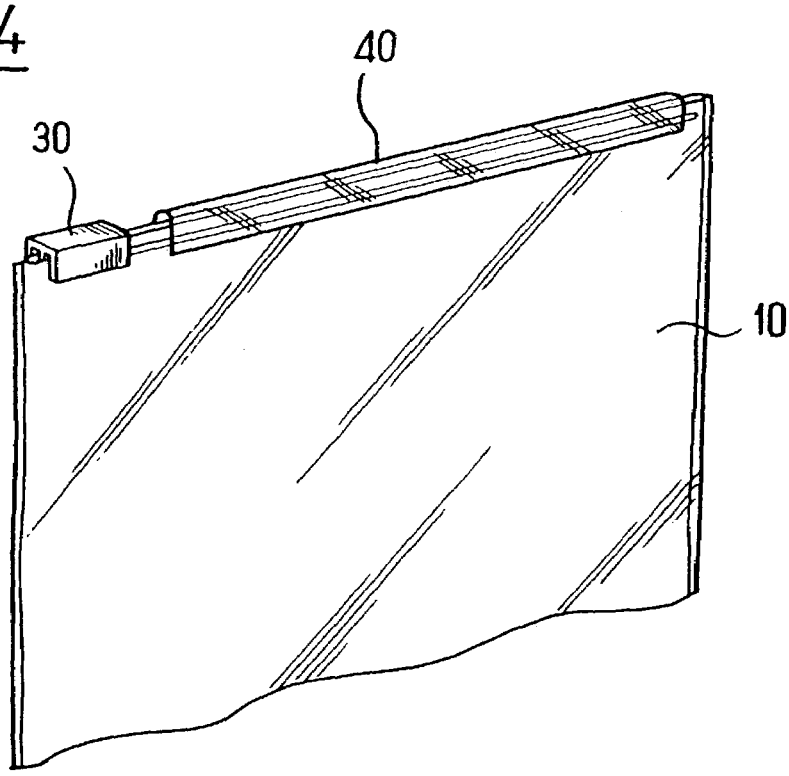
FIG. 4 is a similar diagrammatic view of a bag constituting a variant embodiment of the present invention.

In a variant, as shown in FIG. 4, the marker strip 40 may be continuous along the entire width of the mouth of the bag.

Furthermore, it is advantageous to make the marker strip 40 in the form of a colored strip of color that is different from the remainder of the bag so as to clearly identify the fact that the bag has been opened.

More precisely, in accordance with the invention, the marker strip 40 is of two colors: it presents a first color on its outer face, the only face visible before it is ruptured, and it is of a second color on its inner face, said second color being different from the first and being revealed after the marker strip has been ruptured, as can be seen in FIG. 3, thereby clearly revealing that the strip has been ruptured.

In accordance with another advantageous characteristic of the invention, the marker strip 40 can be fitted with a longitudinal precut line 46 making it easier for the strip to rupture under the application of force by the slider 30.

Figure 5:
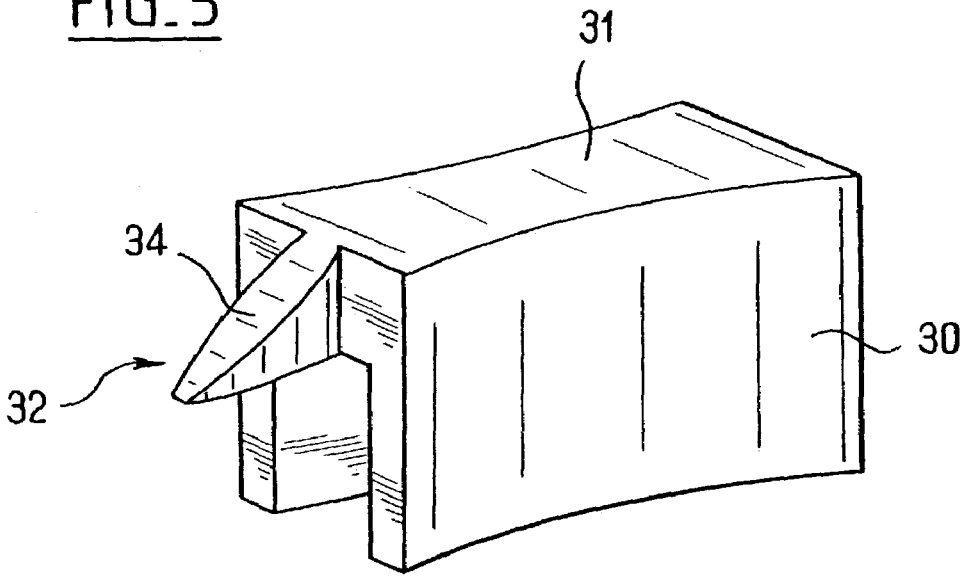
FIG. 5 is a diagrammatic perspective view of a slider constituting a preferred embodiment of the present invention.

As can be seen in FIG. 5, the slider 30 may be provided, where appropriate, at its end that is originally adjacent to the marker strip 40 with a blade or nose 32 designed to engage the inside face of the marker the strip 40 and thus make it easier to rupture the strip.

Advantageously, the blade 32 possesses a leading face 34 that slopes relative to the top face 31 of the slider so as to define progressive engagement between the blade 32 and the marker strip 40. As can be seen in FIG. 5, the leading face 34 of the blade 32 moves away from the plane of the top face 31 of the slider 30 on going towards its tip.

Naturally, such a blade 32 is advantageously formed integrally with the slider 30, e.g. by molding.

The present invention is not limited to the embodiments described above, but extends to any variant within its spirit.

The person skilled in the art will understand that using single-use adhesive zones makes it simple to put the marker strip of the present invention into place whether before, and above all after, the slider 30 has been put into place on the closure strips 20.

What is claimed is:

1. A bag having two walls defining a mouth of the bag, closure strips, a slider, and including a marker strip for preventing manipulation of the slider prior to the marker strip being ruptured, wherein the marker strip is made integrally with one wall of the bag in the vicinity of the mouth of the bag and includes, on an edge opposite the mouth of the bag, a single-use adhesive zone designed to fix the marker strip, in its in-use position, on the opposite wall of the bag, the marker strip being folded over as a U-shape with its concave side facing towards the mouth of the bag, and wherein the marker strip is two-colored: it presents different colors respectively on its outer face and its inner face.

2. A bag according to claim 1, wherein the marker strip is placed on the travel path of the slider.

3. A bag according to claim 1, wherein the marker strip covers the slider.

4. A bag according to claim 1, wherein the marker strip is made of a plastics material.

5. A bag according to claim 1, wherein the marker strip is situated in a position adjacent to the slider when the slider is in its closure position.

6. A bag according to claim 1, wherein the marker strip is U-shaped.

7. A bag according to claim 1, wherein the marker strip is U-shaped with its concave side facing towards the body of the bag.

8. A bag according to claim 1, wherein the marker strip is continuous.

9. A bag according to claim 1, wherein the marker strip extends over the entire length of the mouth of the bag.

10. A bag according to claim 1, wherein the marker strip presents a longitudinal precut line.

11. A bag according to claim 1, wherein the slider is fitted with a blade adjacent to the marker strip.

12. A bag according to claim 11, wherein the blade possesses a sloping leading face.

13. A bag having two walls defining a colored body, a mouth of the bag, closure strips, a slider, and including a marker strip for preventing manipulation of the slider prior to the marker strip being ruptured, wherein the marker strip is formed integrally with one wall of the bag in the vicinity of the mouth of the bag, and includes, on an edge opposite the mouth of the bag, a single-use adhesive zone designed to fix the marker strip, in its in-use position, on the opposite wall of the bag, the marker strip being folded over as a U-shape with its concave side facing towards the mouth of the bag, and wherein the marker strip is of a color different from the color of the body of the bag.

14. A bag according to claim 13, wherein the marker strip is placed on the travel path of the slider.

15. A bag according to claim 13, wherein the marker strip covers the slider.

16. A bag according to claim 13, wherein the marker strip is made of a plastics material.

17. A bag according to claim 13, wherein the marker strip is situated in a position adjacent to the slider when the slider is in its closure position.

18. A bag according to claim 13, wherein the marker strip is U-shaped.

19. A bag according to claim 13, wherein the marker strip U-shaped with its concave side facing towards the body of the bag.

20. A bag according to claim 13, wherein the marker strip is continuous.

21. A bag according to claim 13, wherein the marker strip extends over the entire length of the mouth of the bag.

22. A bag according to claim 13, wherein the marker strip presents a longitudinal precut line.

23. A bag according to claim 13, wherein the slider is fitted with a blade adjacent to the marker strip.

24. A bag according to claim 13, wherein the blade possesses a sloping leading face.

* * * * *

UNITED STATES PATENT AND TRADEMARK OFFICE

CERTIFICATE OF CORRECTION

PATENT NO. : 7,246,944 B2
APPLICATION NO. : 10/613147
DATED : July 24, 2007
INVENTOR(S) : Henri Georges Bois It is certified that error appears in the above-identified patent and that said Letters Patent is hereby corrected as shown below:

Col. 4, line 21;
In Claim #13, line 1, please delete "a colored body,".

Signed and Sealed this

Eighteenth Day of March, 2008

JON W. DUDAS
*Director of the United States Patent and Trademark Office*